United States Patent [19]

Glass et al.

[11] Patent Number: 4,959,051

[45] Date of Patent: Sep. 25, 1990

[54] DUAL CHAMBERED ORAL DOSAGE DELIVERY CONTAINER

[75] Inventors: Richard A. Glass, Richmond, Va.; Robert F. Ryer, II, Red Lion; Deborah T. Tomcanin, Harrisburg, both of Pa.

[73] Assignee: American Home Products Corporation, New York, N.Y.

[21] Appl. No.: 421,038

[22] Filed: Oct. 13, 1989

[51] Int. Cl.[5] ..... A61J 7/00

[52] U.S. Cl. ..... 604/77; 606/234

[58] Field of Search ..... 604/82, 77, 79, 83; 606/234, 235, 236

[56] References Cited

U.S. PATENT DOCUMENTS

| | | | |
|---|---|---|---|
| 3,610,248 | 10/1971 | Davidson | 606/236 |
| 3,875,940 | 4/1975 | Beuther | 606/234 |
| 4,078,566 | 3/1978 | Urban, Jr. | 604/77 |

FOREIGN PATENT DOCUMENTS

| | | | |
|---|---|---|---|
| 754476 | 8/1956 | United Kingdom | 604/77 |

*Primary Examiner*—John D. Yasko

*Attorney, Agent, or Firm*—Richard K. Jackson

[57] ABSTRACT

A dual chambered container for delivery of a liquid medicament comprising a teat sealed to a hollow, bottom compartment by a retaining ring, the teat forming one chamber for diluent or medicament and the bottom forming the other chamber for medicament or diluent, respectively, said chambers being separated by a stopper adapted to seal either the bottom chamber or the teat chamber.

12 Claims, 3 Drawing Sheets

DUAL CHAMBERED ORAL DOSAGE DELIVERY CONTAINER

BACKGROUND OF THE INVENTION

Administration of vaccines or medications by the oral route to neonates, infants or comprised adult patients is frequently quite difficult. Especially in the very young, the problem of regurgitation of the medication is ever present. In the elderly, comprised patient, solid oral dosage forms are frequently difficult to swallow. The need for an inexpensive, convenient, oral delivery system which improves retention of medicament in an infant and increases the ease of the oral dosing of both infants and compromised adults is self-evident. This need is met in both instances by providing a liquid oral dosage delivery system which takes advantage of the natural tendency of an infant to suck from nipples and the ease of liquid oral ingestion over oral solid medicament forms or injectable routes of medication.

BRIEF DESCRIPTION OF THE INVENTION

In accordance with this invention there is provided a dual chambered container for delivery of a liquid medicament comprising a teat sealed to a hollow, bottom compartment by a retaining ring, the teat forming one chamber for diluent or medicament and the bottom formimg the other chamber for medicament or diluent, respectively, said chambers being separated by a stopper. The medicament container, whether it be teat or the hollow container, is always the stoppered vessel within the delivery system. This dual chambered container is especially suitable for separate containment of a diluent and an active soluble, suspendable or lylophylized medicament. This system provides for separate retention of the ingredients in sterile compartments which are easily opened for mixing of diluent and medicament just prior to use. The active medicament is thereby preserved in its most stable form, which is important for storage and shipment of live virus vaccines or immunoglubulins which are heat labile and used as an infant milk supplement.

BRIEF DESCRIPTION OF THE DRAWINGS

FIG. 1 is a side elevational view of the completely assembled dual chambered container for liquid medicament delivery of the present invention.

Figure 2:
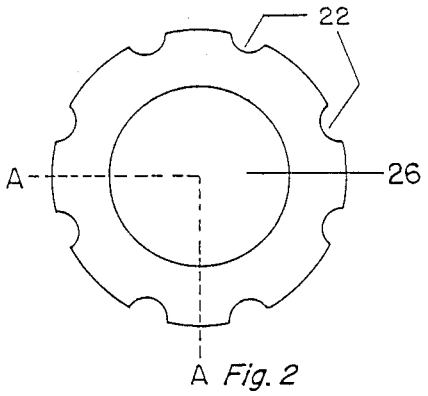
FIG. 2 is a top view of the retaining ring depicted in FIG. 6.

With further reference to the accompanying drawings, the invention provides in detail as shown in FIG. 1, a liquid medicament delivery container 10, especially suitable for dosing infants or the elderly who are not able to easily take conventional solid medication or drink liquids from the conventional glass, cup or spoon. The liquid medicament container 10 comprises a hollow nipple 30 which is secured to a hollow base 50 by a retaining ring 20. The nipple 30 has a node 32 on the top. The node 32 is cut off prior to dosing the patient to create the orifice through which the liquid medicament passes into the mouth of the patient.

Figure 6:
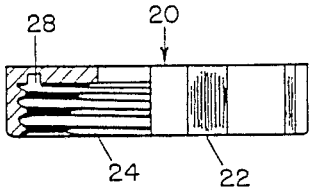

As shown in FIG. 2 and 6, the retaining ring 20 is provided with gripping grooves 22 around its circumference to aid in connecting the female threads 24 shown in FIG. 6 as the section taken along A —A of FIG. 2 to the male threads of bottom member 50.

Figure 7:
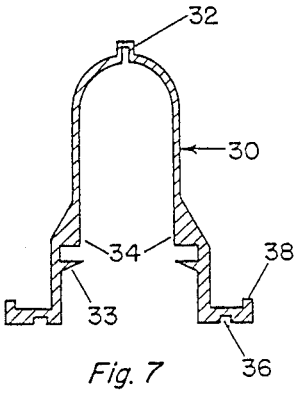

The center of retaining ring 20 is open to provide for positioning and retention of the nipple on the bottom member 50. The retaining ring 20 is provided with a nipple flange receiving slot or groove 28 into which tongue 38 shown in FIG. 7 is seated during assembly of the complete unit to aid in support of the nipple 30. Nipple tongue receiving slot 28 and cooperating nipple 38 are not essential elements of the liquid medicament delivery container when the bottom member nipple seating tongue 56 shown in FIG. 9 provides sufficient support for the nipple 30 via bottom member nipple tongue rabbetted slot 36 shown in FIG. 7.

Figure 3:
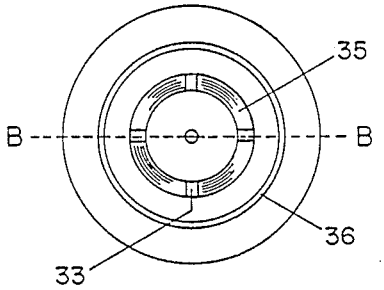
FIG. 3 is an open end view of the nipple depicted in FIG. 7.
Figure 8:
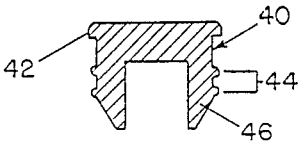

The nipple 30, depicted in FIG. 7 as a cross-section taken on plane B—B of FIG. 3 is equipped with plural internal ribs 34 which serve as stops for the sealing head or crown of stopper 40 shown in FIG. 8. In conjunction with the ribs 34, there are proximally disposed projections 33 which are spaced from ribs 34 a distance determined to receive and secure the head 42 of stopper 40. The ribs 34 serve to prevent the stopper 40 from sealing the nipple cavity which remains open through the sloped areas 35 to permit the liquid in said container to flow throughout the nipple and bottom container member 50 when stopper 40 is dislodged from its seal on the bottom container member 50.

Figure 4:
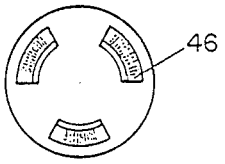
FIG. 4 is a prong end view of a three prong modification of the two prong stopper depicted in FIG. 8.

The stopper 40, depicted in FIG. 8, as a cross-section, provides a stopper crown 42 which seats and completely covers the orifice 58 of the bottom compartment member 50 and isolates that bottom compartment 52 from the nipple cavity. The stopper 40 is depicted in FIG. 8 as having two prongs 46 which serve to direct the stopper in its placement in the bottom compartment member. The prongs have externally disposed nodes 44 which serve to hold the stopper 40 out of union with the bottom compartment member 50 during the manufacture stage of the medicament delivery system. FIG. 4 illustrates a modification of stopper 40 which has three prongs rather than two.

Figure 5:
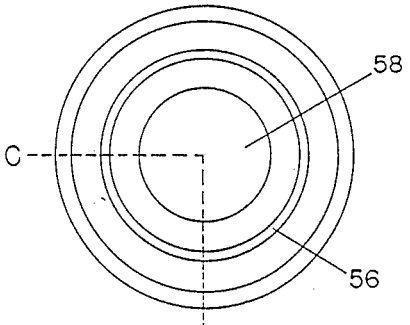
FIG. 5 is an open end view of the bottom member depicted in FIG. 9.
Figure 9:
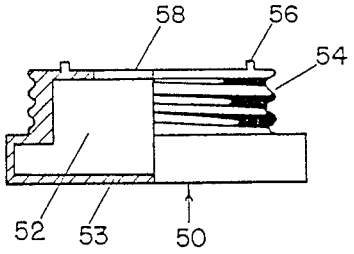

The bottom compartment member 50, depicted in FIG. 9 as a cross-section taken on C—C of FIG. 5 is hollow 52 and provided with an orifice 58 for receipt of stopper 40. The bottom compartment is externally male threaded 54 for connection with the counterpart female threads of retaining ring 20. Said bottom compartment provides a circular nipple seating tongue 56 on its top, which tongue aligns and supports the nipple 30 via the nipple slot 36. The bottom 53 of the bottom compartment member 50 is sufficiently flexible to permit upward pressure on the surface 53 to dislodge the stopper 40 and open the bottom compartment interior 52 to communicate with the nipple cavity.

Figure 10:
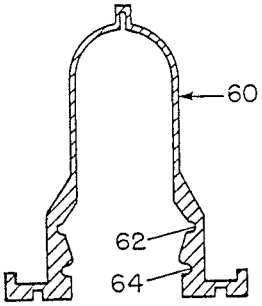
FIG. 10 is a cross sectional view of a modified nipple.
Figure 11:
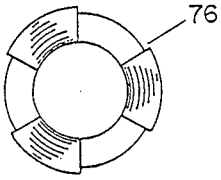
FIG. 11 is a prong end view of a three prong modification of the two prong stopper depicted in FIG. 12 for use with the nipple of FIG. 10.
Figure 12:
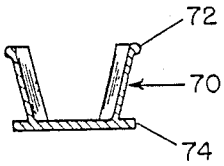
FIG. 12 is a cross sectional view of a stopper for use with the nipple of FIG. 10.

A modification of the nipple stopper seating means is depicted in FIG. 10 where two distinct seating levels provided at 64 and 62 to receive stopper 70 shown in FIG. 12 prong node 72 without sealing the nipple cavity and to receive the bulbous stopper prong node 72 with sealing of the nipple cavity by the stopper head 74. As a modification of the stopper shown in FIG. 12, the three prong stopper of FIG. 11, viewed from the prong end, illustrates the extension 76 of the prongs beyond the radius of the sealing head 74 of the stopper.

The preparation and use of the depicted dual chambered oral delivery device may be best understood with reference to FIGS. 1 and 2 6–9 and the use of rotavirus vaccine. The rotavirus vaccine material is lyophylized in the hollow bottom chamber 50 with the stopper 40 partially inserted and held out of union by the nodes 44. After lyophilization is complete stopper 40 is forced into union with bottom 50 to seal orifice 58. The desired diluent, sterile water or flavored water is placed in nipple 30 and retaining ring 20 joins the nipple to the base by twisting. In use, the flexible bottom 53 of the rotavirus vaccine containing bottom compartment is forced in to contact prongs 46 of the stopper, forcing the stopper out of union with the medicament compartment. The liquid in the nipple is then free to enter the hollow bottom chamber and dissolve or suspend the rotavirus vaccine. The tip 32 is cut from the nipple and the medicament is administered to the patient. The dual chamber delivery bottle is then discarded. In practice, if it is desirable to follow the oral administration with a liquid food such as milk, juice or infant formula, the bottom chamber 50 may be removed and the stopper may be optionally removed and a conventional baby bottle with water, milk, juice, etc. may be attached and the patient fed.

Alternatively, the active medicament may be lyophilized in the nipple 30 and the diluent may be provided in the hollow chamber 50, although it is preferred to construct the device as explained in the preceding paragraph.

In conjunction with the modification depicted in FIGS. 10–12, the same hollow bottom chamber and retaining ring is employed. The device is especially suitable for lyophilization of an active ingredient in the nipple. The stopper 70 is positioned in the first groove 64 during lyophilization and forced into union with the nipple and groove 62 after lyophilization is complete. The device is then assembled with its diluent in the bottom hollow chamber.

To use the device, one must squeeze the nipple at its shoulder to dislodge the stopper and force it downward. The stopper head or crown is smaller than the hole in the bottom compartment, so once it is freed from union with the nipple, the diluent in the bottom is free to mix with material in the nipple. After mixing, the medicament is administered and the device may be discarded.

The components of the device of this invention are made from conventional materials. For example, the hollow bottom chamber may be molded from any, preferably translucent, sterilizable polymeric material capable of withstanding temperatures between about −60° C and 135° C, which is flexible and thin enough to be deformed to dislodge the stopper.

The nipple is made from steam sterilizable butyl rubber or analogous bromo- or chloro-butyl rubber materials (isobutene-isoprene copolymers).

The stopper is steam sterilizable rubber made of the same or similar materials as the nipple.

The retaining ring is molded from sterilizable hard plastic materials.

What is claimed is:

1. A dual chambered container for delivery of a liquid medicament comprising a hollow, bottom chamber provided with an orifice on its upper surface, said bottom chamber being partially, externally threaded on the orifice side and cooperatively connected thereby to matching, internally disposed female threads of a retaining ring through which retaining ring a sealed, resilient teat is centrally disposed and secured by is base flange which is sealed between said bottom chamber and said retaining ring to form a second chamber in said teat, said chambers being separated by a stopper, and said being provided with (1) a removable, outwardly projecting tip, which when removed opens the nipple orifice through which said liquid medicament discharge is regulated, and (2) an enlarged, internal lower region extending to the open externally flanged base.

2. The container of claim 1 in which said stopper serves to seal said bottom chamber and said enlarge internal region of the teat contains plural internally projecting ribs and proximal projections which form plural recessed seats with said ribs, adapted to receive and secure the crown of said stopper in such manner as to permit free flow of diluent contained in the teat into said hollow bottom chamber to mix the diluent with a non-liquid medicament contained in said bottom chamber.

3. The container of claim 2 in which said teat contains from two to six internally projecting ribs and proximal projections.

4. The container of claim 3 in which said teat contains four internally projecting ribs and proximal projections.

5. The container of claim 1 in which the bottom surface of externally flange at the base of said teat is rabbetted to receive a corresponding tongue on the upper surface of said hollow, bottom chamber.

6. The container of claim 5 in which the external flange at the base of said teat has a tongue on its upper surface adapted to fit a groove on the upper interior surface of said retaining ring.

7. The container of claim 2 in which said bottom is rigid except at its bottom which is sufficiently flexible to permit inward displacement to contact one or more of plural prongs integral with and extending from the crown of said stopper into the bottom chamber, thereby displacing said stopper into the enlarged section of the teat, the crown of said stopper being larger than the orifice of said bottom chamber and smaller than the inside of said teat.

8. The container of claim 2 in which said stopper has two to four prongs adapted to position the stopper crown in the hollow bottom chamber orifice in either a fully closed position or a partially closed position, the positioning being controlled by small nodes on the external surface of said prongs, to provide in its partially closed position, for vapor removal during lyophilization of medicament in the hollow bottom chamber.

9. The container of claim 8 in which said stopper has three prongs.

10. The container of claim 7 in which said stopper crown is chamfered on its upper peripheral surface.

11. The container of claim 1 in which said stopper serves to seal said test chamber and its base and the enlarged, internal lower region of the teat is adapted by means of grooves to receive the bulbous tip of the prongs of said stopper and position the crown of said stopper in either a fully closed position where surface of the stopper crown is sealed against the bottom of the teat base flange or in a partially closed position.

12. The container of claim 11 in which the crown of said stopper is smaller than the orifice of the hollow bottom chamber.

* * * * *